United States Patent [19]

Tippets

[11] 4,400,016

[45] Aug. 23, 1983

[54] ACCOUNTING APPARATUS AND METHOD

[76] Inventor: Wayne M. Tippets, 2933 N. Casa Tomas, Phoenix, Ariz. 85016

[21] Appl. No.: 158,076

[22] Filed: Jun. 10, 1980

[51] Int. Cl.[3] ..... B42D 11/00; B41L 3/04

[52] U.S. Cl. ..... 283/66 R; 282/29 B

[58] Field of Search ..... 283/66 R, 66 A; 282/29 R, 29 B, 29 A

[56] References Cited

U.S. PATENT DOCUMENTS

| | | | |
|---|---|---|---|
| 2,485,513 | 10/1949 | Straus | 282/29 B |
| 2,598,358 | 5/1952 | Connor | 282/29 B |
| 2,678,223 | 5/1954 | Shepherd | 282/23 R |
| 3,073,625 | 1/1963 | Petit | 282/29 B |
| 3,177,010 | 4/1965 | Stroh | 282/23 R |
| 3,236,542 | 2/1966 | Russell | 282/29 B |
| 3,480,298 | 11/1969 | Garbor | 282/29 A |
| 3,645,561 | 2/1972 | Kendall | 282/29 B |
| 3,661,407 | 5/1972 | Warren | 283/55 |
| 4,002,356 | 1/1977 | Weidmann | 282/29 B |
| 4,014,566 | 3/1977 | Cantrell | 282/8 R |
| 4,179,139 | 12/1979 | Savar | 283/58 |

*Primary Examiner*—Paul A. Bell
*Assistant Examiner*—John S. Brown
*Attorney, Agent, or Firm*—Harry M. Weiss

[57] ABSTRACT

This disclosure relates to an apparatus for and a method of accounting which incorporates an imprinting apparatus to serve as a device to render multiple impressions from a single imprinting of information on the face of a check so that a journal of expenditures is maintained and a ledger of accounts of particular expenditures can be developed.

1 Claim, 9 Drawing Figures

FIG 3
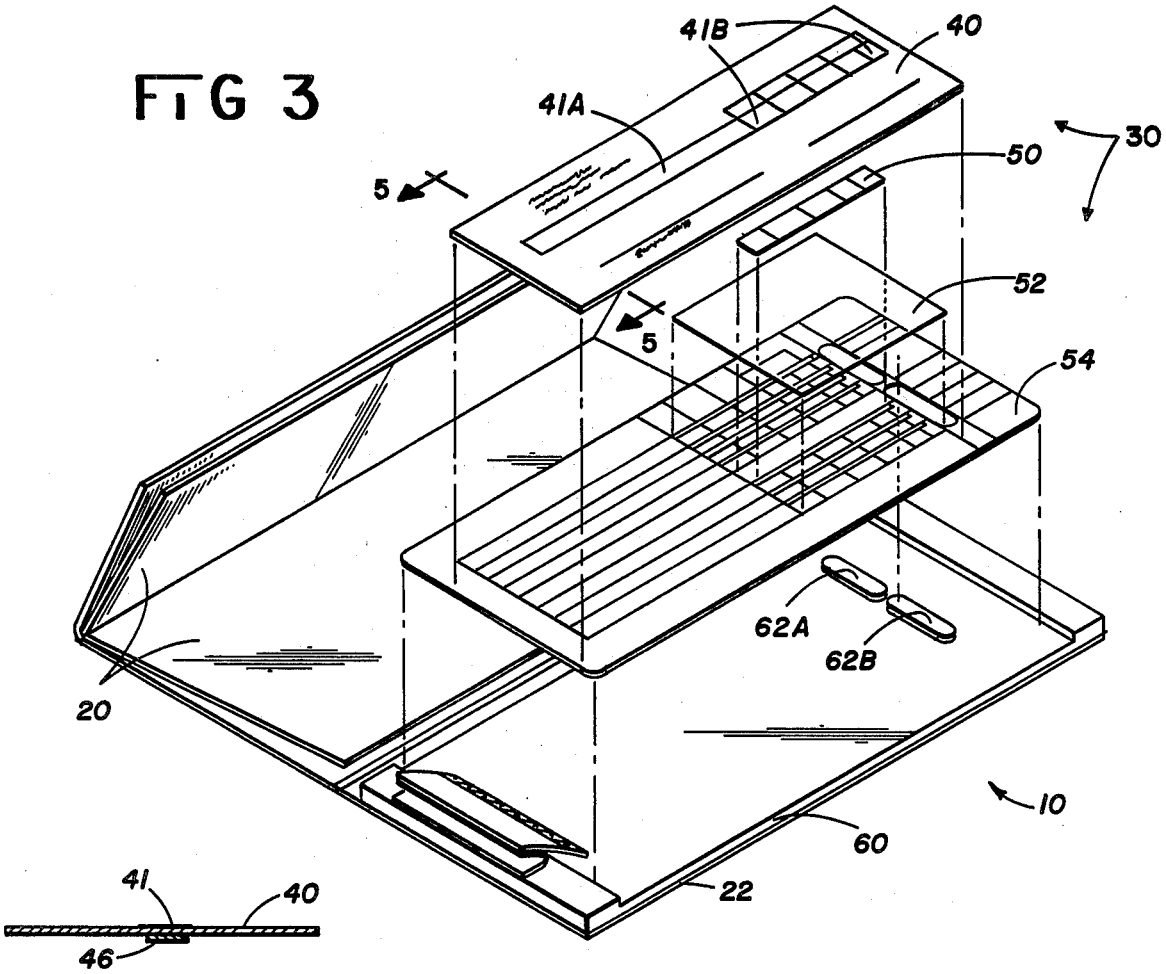
FIG 5
FIG 4
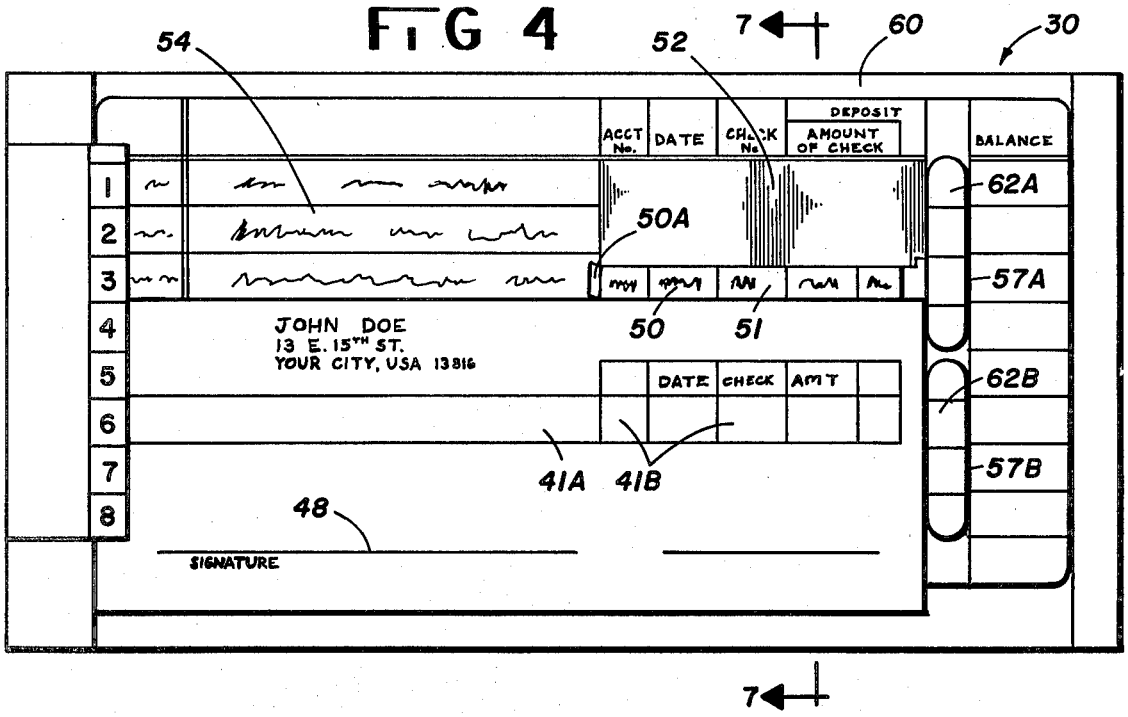

ACCOUNTING APPARATUS AND METHOD

BACKGROUND OF THE INVENTION

1. Field of the Invention

This invention relates generally to an apparatus for and methods of accounting and, more specifically, to an apparatus for and a method of disbursements accounting requiring only a single manual imprinting of the information pertaining to a particular transaction while providing multiple reproductions of the imprinted information. This invention relates further to an apparatus useful for maintaining personal checking records including a journal of disbursements and various accounts collected in a ledger.

2. Description of the Prior Art

In the past, financial intercourse has necessitated the maintenance of records as a managerial tool. Commonly, disbursements were made by a written negotiable instrument, or check. The check was issued, or drawn, to a payee, who cashed the check which eventually returned to the possession of the drawer. The balance in the checking account was monitored by maintaining a journal or register which was commonly, but not universally, incorporated in the same cover as a supply of undisbursed checks. As a check was drawn, the check number, identity of the payee and amount were recorded in the journal. The journal was a running account of the balance in the checking account, and was correspondingly debited for checks drawn and credited for deposits made. Since the recordation in the journal required a second writing, the ever present danger of transcription errors was presented. Such errors commonly included transposition of digits, etc.

Effective financial management, whether for an individual or a business enterprise, required analysis of the ongoing character, magnitude and distribution of disbursements. To this end, various accounts were established to collect and develop a record of disbursements made for particular purposes. Most commonly, the respective accounts were bound in a common ledger. The posting of particular expenditures from the journal to an account also required a third writing, again giving rise to possible transcription errors.

Subsequently, commercial type bookkeeping systems were developed which utilized sheaves of sequentially bound checks each having a reproducing carbonized strip on a back portion of the check and an alignment mechanism so that the check was self positioning over a particular journal entry prior to imprinting, to permit the relevant portions of the information on the face of the check, such as amount, payee and date, to be reproduced on the journal. However, subsequent posting of the transaction to an account still required transcription. A need existed for a disbursements accounting system which would allow a check to be drawn and a journal entry and a ledger entry to each be made from a single imprint of the pertinent information.

Consumer checking was conducted using a well known checkbook apparatus provided with a series of bound checks and a checking account register, or journal, coupled in a common cover. The commercial type checking systems capable of reproducing a single imprint from the check onto the journal were bulky, and utilized the sequentially bound sheave of checks, which two features were incompatible with consumer transactions due to the conflict of the physical dimensions with the convenience and mobility of the user. Furthermore, the conventional checkbook as used by the consumer made no provision within that apparatus for establishing expenditure accounts collected in a ledger, much less for reproducing the information required for the ledger as a part of a single imprinting operation when drawing the check. A need existed for a consumer checking apparatus having a reasonable size so as to be compatible with consumer mobility, capable of recording journal entries from a single imprinting of the information on a check, and further preferably capable of recording, without requiring a transcription, the information imprinted on the check in a manner to permit inclusion of that information in an account portion of a ledger which was an integral part of the checkbook apparatus.

BRIEF DESCRIPTION OF THE DRAWING

FIG. 3 is a perspective view of a disbursements accounting apparatus with portions spaced apart for clarity.

FIG. 4 is a top view of the imprinting apparatus.

FIG. 5 is a sectional view taken along line 5—5 of FIG. 3.

SUMMARY OF THE INVENTION

Figure 1:
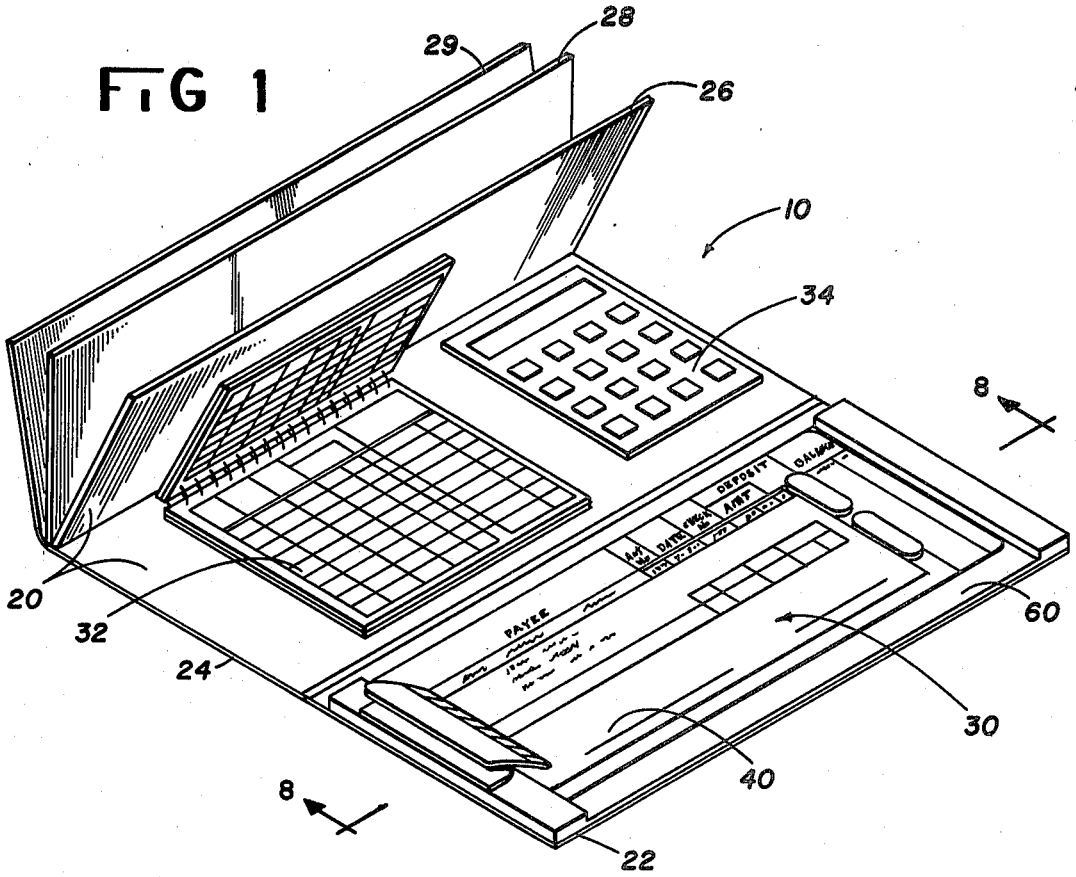
FIG. 1 is a perspective view of an open disbursements accounting apparatus.

In accordance with one embodiment of this invention, it is an object to provide an apparatus for disbursing funds.

It is another object to provide an apparatus for maintaining a record of disbursements while requiring only a single imprinting of the information bearing on a particular transaction.

It is still another object to provide a method for maintaining a record of disbursements while requiring only a single imprinting of the information bearing on a particular transaction.

It is still another object to provide an apparatus for collecting at least two accounts embodying disbursements of a particular nature while requiring only a single imprinting of the information bearing on a particular transaction.

It is a further object to provide an apparatus for permitting an imprinted information bearing strip to be transferred and adhesively coupled to a page to record a particular type of expenditure in an account.

It is yet a further object to teach a method of disbursing funds so that an accumulating record of transactions is developed while requiring only a single imprinting of its information bearing on a particular transaction.

It is again another object to teach a method of developing accounts of particular types of expenditures by transferring adhesive information bearing strips while requiring only a single imprinting of the information bearing on a particular transaction.

DESCRIPTION OF THE PREFERRED EMBODIMENTS

In accordance with one embodiment of this invention, a disbursements accounting apparatus is disclosed, comprising: an instrument having at least a first designated area and other information printed on an upper surface thereof so that the name of a payee and the amount of the instrument can be imprinted within the first designated area; first duplicating means at least selectively in communication with a lower surface of the instrument directly behind the first designated area for transferring information recorded upon the first designated area to a surface behind the instrument; a plurality of strips each having a second designated area on an upper surface thereof disposed to record information transferred by the first duplicating means; a second duplicating means at least selectively in communication with a lower surface of the strip directly behind the second designated area for transferring information recorded upon the second designated area to a surface behind the strip, at least one journal card having a plurality of sequential third designated areas individually disposed to record information transferred by one of the second duplicating means on an upper surface thereof; and retaining means for securing the first, one of the second and one of the third designated areas in alignment.

In accordance with another embodiment of this invention, a combined check writing and accounting apparatus is disclosed, comprising, in combination: a check having first reproducing means for permitting the identification of the payee and at least a portion of the other information written on areas on the front of the check to be transmitted through the check onto an information receiving medium; at least one strip having an area correspondingly similar to the areas on the front of the check; and gripping means for releasably holding both the check and the strip to permit information written on the front of the check to be transmitted through the check onto the strip.

In accordance with still another embodiment of this invention, a method for recording disbursements in organized accounts is disclosed, comprising the steps of: providing a check having a signature line on the face thereof; defining areas remote from the signature line in a linear manner across the face of the check to receive at least an identification of the payee on a left portion thereof and the amount of the check on a right portion thereof; providing a plurality of strips; adhesively coupling the strips to a backing surface in a columnar manner; aligning the areas on the right portion of the check over one of the strips; securing the strip with the area on the right portion of the check over the strip; imprinting the identification of payee on the left portion and the amount on the right portion; simultaneously with the step of imprinting transferring the identification of payee and amount to the strip; signing the check on the signature line; removing the check; removing the strip; and adhesively applying the strip to a particular page of a ledger book so that particular types of expenditures can be identified.

The foregoing and other objects, features and advantages will be apparent from the following, more particular, description of the preferred embodiments of the invention, as illustrated in the accompanying drawings.

THE SPECIFICATION

Figure 2:
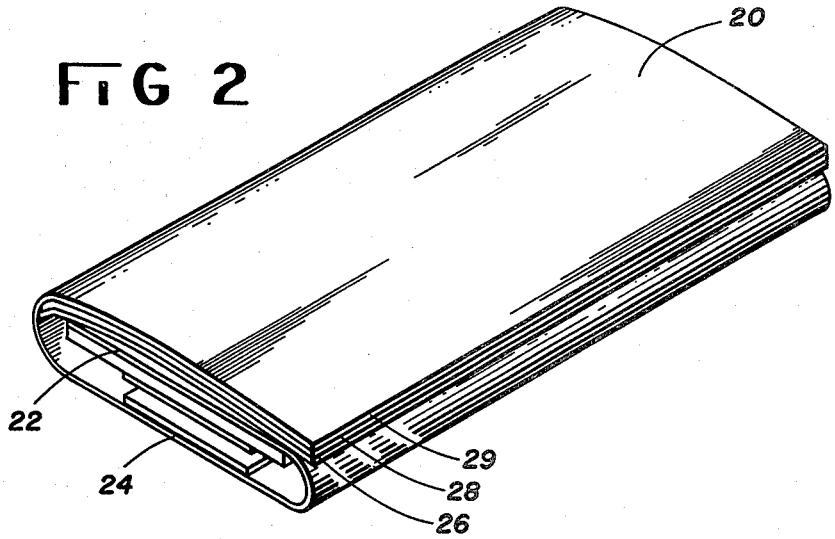
FIG. 2 is a perspective view of a folded disbursements accounting apparatus.

Referring to FIG. 1, an embodiment of a disbursements accounting, or check writing and accounting, apparatus is shown generally by reference number 10. The disbursements accounting apparatus 10 is shown provided with a folder 20 which can be conveniently folded to provide protection for the other elements of the apparatus 10 during periods of storage or transportation. Referring also to FIG. 2, the accounting apparatus 10 is shown folded into a compact unit. The folder 20 is fabricated from leather or other tough, flexible material. The folder 20 has a backing member portion 22, a ledger book portion 24, a check pocket portion 26, a first journal card pocket portion 28, and a second journal card pocket portion 29, all of which are hingedly coupled to the accounts book portion 24. The check pocket portion 26 is utilized to store checks or instruments 40 which are commonly used to disburse funds; the first and second journal card pockets 28, 29 are respectively utilized to store unused journal cards 54 (refer to FIG. 3) and the journal cards 54 after information imprinted on the face of a series of instruments 40 has been transferred to a surface of the journal card 54 to provide a record of disbursement and deposit transactions.

The backing member portion 22 is coupled to an imprinting apparatus, shown generally by reference number 30. A ledger book 32 and a calculator 34 are attached to the ledger book portion 26 to allow the accounting apparatus 10 to be unfolded to expose the various locations where information is to be recorded as a part of the disbursements process.

Referring to FIG. 3, a perspective view of an accounting apparatus 10 is shown with the information receiving elements of the imprinting apparatus 30 spaced apart for clarity. The imprinting apparatus 30 allows multiple images of information recorded on the instrument, or check, 40 to be reproduced from a single writing of that information.

Referring also to FIG. 4, a top view of the imprinting apparatus 30 is shown, provided with the instrument 40 which has an area, more specifically a first designated area 41, defined on an upper surface. The first designated area 41 is divided, for example, into a payee identification area 41A and an amount identification area 41B. The amount identification area 41B can be further subdivided into areas disposed to record the date, check number, the number of the account to which the transaction is to be debited or credited, and the number of dollars and cents involved in the particular transaction. The lower surface of the instrument at least selectively communicates with a first duplicating means for transferring information recorded on the first designated areas 41 to a surface behind the instrument 40. Referring also to FIG. 5, a sectional view taken along line 5—5 of FIG. 3, the first duplicating means is shown, as for example, as a carbonized strip 46 of a well known character coupled to the instrument 40 directly behind the entire first designated area 41. The face of the instrument 40 also has a signature line 48, disposed to receive the signature of a drawer, defined thereon in a position generally directly below the payee identification area 41A, so that the imprint of a signature does not produce undesired reproductions, as hereinfater explained.

A plurality of strips 50 are each provided with an upper surface having a second disignated area 51 which is a defined area correspondingly similar to the amount identification area 41B. In use, the amount identification area 41B is selectively positioned over sequential individual ones of the plurality of strips 50 so that information recorded upon the amount identification area 41B is simultaneously transferred to and recorded upon the second designated area 51 on the upper surface of the strip 50. The lower surface of the strip 50 at least selectively communicates with second duplicating means for transferring information recorded upon the second designated area 51 to a surface behind the strip 50. The second duplication means can be, as for example, a carbonized sheet 52 (for clarity shown in FIG. 4 as a transparent member). The carbonized sheet 52 can be a sheet of carbon paper having a carbonized lower surface 52A (Refer to FIG. 7). Alternatively, the second duplicating means could be comprised of a carbonized lower surface of the strip 50. The carbonized sheet 52 is removably coupled to the journal card 54, as for example by staples or an adhesive applied to the peripheral portions of the lower surface of the carbonized sheet 52. The carbonized sheet 52 underlies a portion of the instrument 40 in a manner such that the signature of the drawer is not reproduced thereby.

Figure 6:
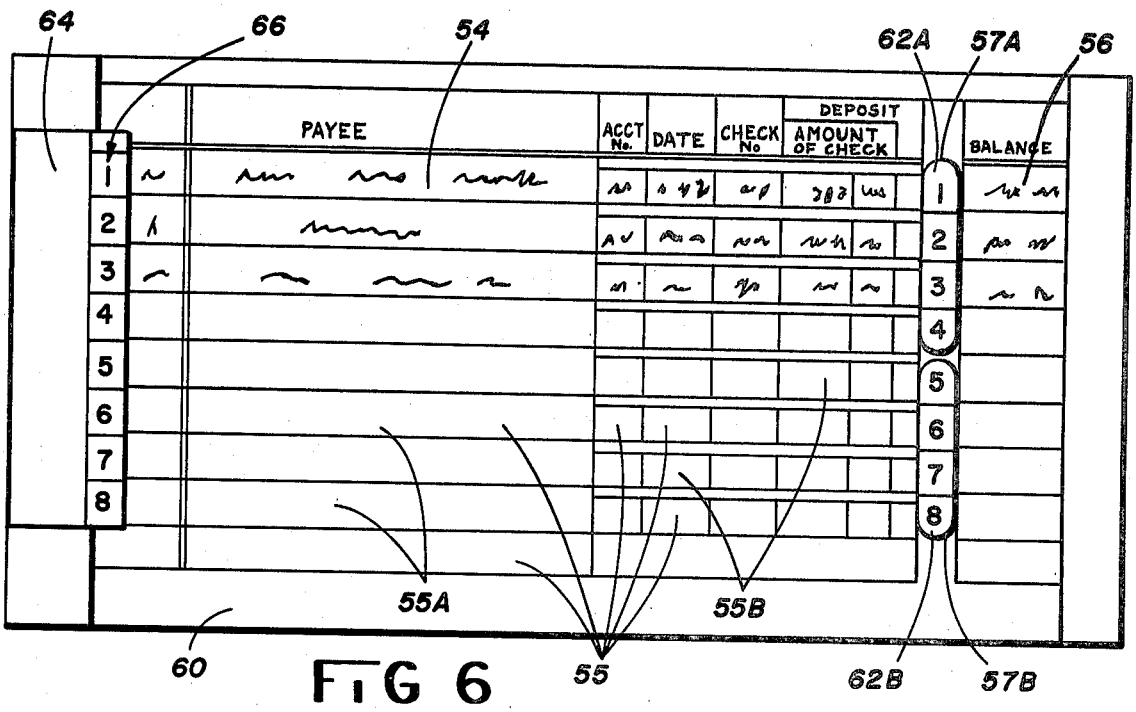
FIG. 6 is a top view of the imprinting apparatus with portions removed for clarity

Referring further to FIG. 6, a top view of the imprinting apparatus 30, similar to FIG. 4, is shown with the strips 50 and the carbonized sheet 52 removed to more clearly illustrate the other features of the imprinting apparatus 30. Specifically, the journal card 54 is provided with a plurality of third designated areas 55, each of which is defined, in a manner similar to the first designated area 41, into a payee identification area 55A and an amount identification area 55B, and additionally into a plurality of balance areas 56 each corresponding to one of of the third designated areas 55. As each transaction is entered on the face of a properly positioned instrument 40, the identification of the payee, amount, etc. are reproduced on one of the plurality of third designated areas 55, and the adjusted balance can be conveniently recorded on a corresponding one of the balance areas 56. Successive instruments 40 are sequentially positioned over different ones of the plurality of third designated areas 55 to provide and maintain a running record of disbursements and deposits.

The imprinting apparatus 30 is provided with retaining means for securing the first 41, one of the second 51 and one of the third 55 designated areas in alignment so that information imprinted within the amount identification area 41B is reproduced on the strip 50 and all of the information recorded on the first designated areas 41 is reproduced on one of the third designated areas 55 of the journal card 54.

In the first embodiment 10, the retaining means are shown as a backing member 60 coupled to the backing member portion 22 of the folder 20. The backing member 60 is preferably fabricated from a material suitable for establishing a rigid writing surface, as for example, particle board or polystyrene plastic. The retaining means are further comprised of at least a post member 62, shown as first and second posts 62A, 62B, coupled to the backing member 60, and a corresponding aperture 57 in the ledger card 54, shown as first and second apertures 57A, 57B. The posts 62A and 62B have indicia thereon to help align the check 40. The indicia assist in manually aligning the first designated area 41 of each of the respective instruments 40 with a corresponding underlying sequential one of the second and third designated areas 51, 55. The first and second apertures 57A, 57B are disposed to engage the first and second posts 62A, 62B to prevent rotation or translation of the journal card 54 on the anterior surface of the backing member 60.

The retaining means also incorporate adhesive means for releasably coupling the individual strips 50 to a surface. The adhesive means are advantageously permanently coupled to the lower surface of the strip 50 and releasably coupled to the upper surface of either the journal card 54 or, when the carbonized sheet 52 is coupled to the upper surface of the journal card 54, to the upper surface of the carbonized sheet 52. The strips 50 are coupled to the journal card 54 in a manner so that each one of the second designated areas 51 are aligned immediately above one of the amount areas 55B of the third designated area 55.

Figure 7:
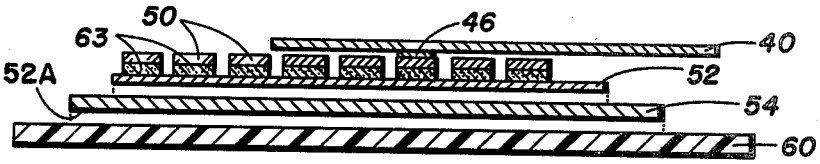
FIG. 7 is a sectional view taken along line 7—7 of FIG. 4.

Referring also to FIG. 7, a sectional view taken along line 7—7 of FIG. 4, it can be seen that the strips 50 are individually retained by and coupled to the journal card 54 or the carbonized sheet 52 by the adhesive means, as for example an adhesive strip 63 permanently coupled to the lower surface of the strip 50. Preferably, the strip 50 has a stub portion 50A (refer to FIG. 4) at one end which does not have an inferior adhesive strip 63 to provide a convenient grip to facilitate removal of the strip 50.

Figure 8:
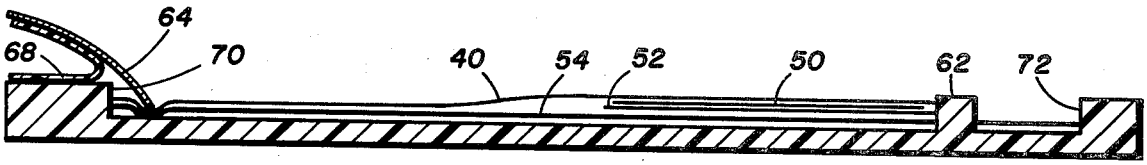
FIG. 8 is a sectional view taken along line 8—8 of FIG. 1.

Referring further to FIG. 8, a sectional view taken along line 8—8 of FIG. 1, it can be seen that the retaining means utilizes clamp means for releasably coupling the instrument 40 to the backing member 60 so that the payee identification area 41A and the amount area 41B of the first designated area 41 can be respectively secured directly above the payee identification area 55A of the journal card 54, and above the second designated area 51 of a selected one of the strips 50. The clamp means are shown as a lever member 64 hingedly coupled to an end of the backing member 60 at a point distal to the post members 62A, 62B. The lever member 64 is provided with reference means, as for example a series of reference characters located near an end of the lever 64, shown generally by reference number 66, for permitting a convenient identification of the respective third designated area 55 and further permitting rapid alignment of the first designated area with the appropriate ones of the second and third designated areas 51, 55 as previously described. The clamp means are further comprised of bias means for releasably biasing one end of the lever 64 toward the upper surface of the backing member 60. The bias means are comprised of a spring 68 coupled to both the backing member 60 and the lever member 64. As shown, the spring 68 also functions as a hinge. The retaining means also incorporate a first rail 70, which is coupled to the backing member 60 so that an end of the instrument 40 can be manually against the rail 70 to laterally position the first designated area 41 over the second and third designated areas 51, 55. It will be apparent to one skilled in the art that the instrument could be further provided with one or more apertures positioned to engage at least one of the post members 62 to provide a positive means of longitudinally positioning the first designated area 41 over the appropriate second and third designated areas 51, 55. The retaining means also incorporate a second rail member 72 coupled to the backing member 60 distal to the first rail 70, so that a similar backstop is provided for the journal card 54.

Figure 9:
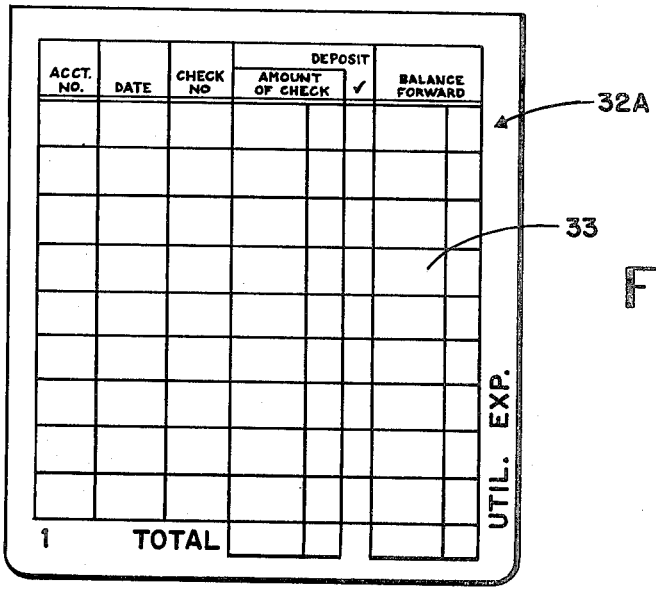
FIG. 9 is a top view of a typical account page from the ledger book.

Referring to FIG. 9, a typical page, from the plurality of pages of which the ledger book 32 is formed, is shown generally be reference number 32A. The individual pages are respectively identified to permit a user to segregate accounts to monitor expenditures as may suit the particular needs of the user. A plurality of fourth designated areas 33 are defined on the surface of the page 32A in a manner to permit individual ones of the ledger strips 50 to be adhesively coupled thereto by the adhesive strip 63. The accounts thus defined can be easily tabulated to provide a valuable financial monitoring tool for the user.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A disbursements accounting apparatus, comprising:

at least one instrument having at least a first designated area and other information printed on an upper side thereof so that the name of a payee and the amount of said instrument can be imprinted within said first designated area;

first duplicating means at least selectively in communication with a lower surface of said instrument for transferring information recorded upon said first designated srea to a surface behind said instrument;

said first duplicating means being located directly behind said first designated area;

a plurality of removable strips each having a second designated area on an upper surface thereof disposed to respectively record information transferred by a specific one of said first duplicating means;

a second duplicating means at least selectively in communication with a lower surface of said strip directly behind said second designated area for transferring information recorded upon said second designated area to a surface behind said strip;

at least one journal card having a plurality of sequential third designated areas individually disposed to record information transferred by one of said second duplicating means onto an upper surface thereof;

retaining means for securing said first, one of said second and one of said third designated areas in alignment so that an inscription on said first designated area also produces images on said ones of said second and third designated areas;

said retaining means comprising adhesive means coupled to said individual strips and to said journal so that individual ones of said second and third designated areas are aligned for releasably coupling said designated strips to a surface;

said retaining means further comprising a substantially rigid backing member;

said retaining means including a first post member coupled to an interior portion of an upper surface of said backing member;

said retaining means provided with said journal card defining an aperture disposed to engage said post member so that translation and rotation of said journal card are prevented when so engaged;

said retaining means having said clamp for clamping a portion of each of said instrument and said journal card to said backing member;

said retaining means also including said post member having identification means for permitting identification of individual ones of said plurality of third designated areas.

* * * * *